US010736190B1

(12) United States Patent
Lindsay

(10) Patent No.: US 10,736,190 B1
(45) Date of Patent: Aug. 4, 2020

(54) INDICATOR LIGHT ASSEMBLY

(71) Applicant: Eaton Intelligent Power Limited, Dublin (IE)

(72) Inventor: Charles N. Lindsay, Tyrone, GA (US)

(73) Assignee: EATON INTELLIGENT POWER LIMITED, Dublin (IE)

( * ) Notice: Subject to any disclaimer, the term of this patent is extended or adjusted under 35 U.S.C. 154(b) by 0 days.

(21) Appl. No.: 16/364,571

(22) Filed: Mar. 26, 2019

(51) Int. Cl.
*H05B 45/10* (2020.01)
*F21V 19/00* (2006.01)
*G04B 19/26* (2006.01)

(52) U.S. Cl.
CPC ..... *H05B 45/10* (2020.01); *F21V 19/001* (2013.01); *G04B 19/262* (2013.01)

(58) Field of Classification Search
None
See application file for complete search history.

(56) References Cited

U.S. PATENT DOCUMENTS 5,589,741 A * 12/1996 Terman ..... H05B 37/0218 315/156
2007/0057806 A1* 3/2007 Nelson, Jr. ..... B60Q 1/2611 340/815.4
2012/0280793 A1* 11/2012 Fayfield ..... G06F 1/3206 340/8.1
2017/0079480 A1* 3/2017 Tsibulevskiy ..... A47K 3/281
2017/0282784 A1* 10/2017 Foster ..... A01B 76/00

* cited by examiner

*Primary Examiner* — Crystal L Hammond
(74) *Attorney, Agent, or Firm* — Eckert Seamans Cherin & Mellott, LLC

(57) ABSTRACT

A control assembly for an indicator light, (wherein the indicator light structured to emit light in more than two output modes) includes a locator assembly structured to determine the astronomic data for the indicator light, a selector assembly structured to select an output mode of the indicator light, and an output assembly structured to control the output modes of the indicator light. The locator assembly is in electronic communication with the selector assembly. The locator assembly communicates astronomic data for the indicator light to the selector assembly. The selector assembly selects an output mode of the indicator light based on the astronomic data for the indicator light.

20 Claims, 3 Drawing Sheets

INDICATOR LIGHT ASSEMBLY

BACKGROUND OF THE INVENTION

Field of the Invention

The disclosed and claimed invention relates to an indicator light assembly and, more specifically, to a control assembly for an indicator light.

Background Information

Many devices, and notably "smart devices," have indicator lights to provide information regarding the device and/or the load being controlled. These are typically binary indicator lights that are structured to be in one of two output modes, e.g., on/off or bright/dim. Thus, an indicator light is structured to communicate information to a user regarding the state of a device associated with the indicator light. Conversely, an indicator light is not structured to generally illuminate an area. Thus, it is understood that, and as used herein, an "indicator light" is always associated with another construct or device. Further, the other construct is typically an electronic device.

Many devices such as, but not limited to, televisions, DVD players, video game consoles, audio equipment, computers, monitors, chargers (i.e., AC/DC converters) smart light switches/dimmers and other smart devices, utilize indicator lights. For example, a power strip typically includes an on/off switch that is illuminated by an indicator light. In this example, the "indicator light" is associated with the on/off switch and indicates the configuration of the on/off switch (which, in turn, indicates the state of the power strip). When the on/off switch is in the "on" position, the indicator light is illuminated thereby communicating to a user that power is being provided to the sockets of the power strip. Conversely, when the on/off switch is in the "off" position, the indicator light is not illuminated thereby communicating to a user that power is not being provided to the sockets of the power strip. As used herein, an indicator light is in an "output mode" only when the indicator light is powered. That is, for example, during a power outage, neither the indicator light nor the power strip receives enemy; thus, the indicator light is not illuminated and the power strip is not energized. The lack of power is not, however, related to the configuration of the on/off switch. That is, the on/off switch could be in the "on" position and, during normal usage, would be illuminated. The lack of power, however, prevents illumination of the indicator light. Thus, the indicator light does not actually indicate the status of the on/off switch.

While indicator lights are not intended to illuminate an area, indicator lights are, or can be, very bright. Such bright indicator lights are a problem when they are too bright. That is, such indicator lights are structured to be seen in bright and/or daytime light and, as such, are too bright for low light. For example, when a user is watching television, i.e., when not playing a video game, a bright indicator light on a video game console located adjacent a television interferes with a user's enjoyment of the television. As another example, assuming a person recharges their cellular telephone on a nightstand adjacent a bed, when an indicator light on a charger is too bright, the indicator light disturbs a person trying to sleep in the bed. As a further example, smart light switches typically include at least one light emitting diode (hereinafter, "LED") while a smart dimmer switch typically includes a plurality of LEDs. Such smart light switches are often located in bedrooms and may interfere with someone trying to sleep in the bedroom.

One solution to overly bright indicator lights was to only illuminate the indicator light based upon the condition of the associated construct or device. For example, if the associated device was connected to a live line, i.e., powered, the indicator light was illuminated, i.e., in the "on" output mode. Conversely, if the other device was not powered (i.e., coupled to an energized source of power but wherein the device was turned off), the indicator light was not illuminated, i.e., the indicator light was in the "off" output mode. Alternatively, some indicator lights were structured to be in one of the bright/dim output mode depending upon the state of the associated device. For example, a video game console indicator light is in the dim output mode when the console is not in use and in the bright output mode when the console is in use. In this configuration, a video game console's indicator light may be too bright when playing a video game. That is, in a dark room a video game console's indicator light may be distracting to a player.

Another solution provides for a control construct for the indicator light. Such a control construct is, typically, coupled to a photocell or similar device. In this configuration, the photocell sends a signal to the control construct which, in turn, causes the indicator light to illuminate (the "on" output mode) or disables the indicator light (the "off" output mode) depending upon the illumination at the photocell. It is noted that some photocells are structured to react only to sunlight as opposed to artificial light. Thus, unless the photocell is exposed to sunlight, the associated indicator light is in the on/bright output mode.

These devices also have problems. First, such a control system requires a photocell. Second, the control system for the photocell, which is in either the photocell or the control construct, is complicated and expensive. Third, either of the two output modes of the indicator light, i.e., on/bright or off/dim, may not be suitable for the location of the indicator light. That is, for example, the on (or bright) output mode may be suitable for daytime and/or direct sunlight and the off (or dim) output mode may be suitable for night, but neither output mode may be suitable for twilight or an overcast day. Alternatively, the device associated with the indicator light may be in a location wherein the ambient illumination does not change, e.g., a room with no windows, and, as such, a photocell that is only sensitive to sunlight would never change the output mode of the indicator light.

Accordingly, there is a need for a controller assembly for an indicator light that is structured to cause the indicator light to change output modes based on causes other than the ambient illumination and/or the state of the associated device. There is a further need for a controller assembly for an indicator light that is structured to cause the indicator light to change between more than two output modes.

SUMMARY OF THE INVENTION

These needs, and others, are met by at least one embodiment of the disclosed and claimed concept which provides a controller assembly for an indicator light, (wherein the indicator light is structured to emit light in more than two output modes) that includes a locator assembly structured to determine the astronomic data for the indicator light, a selector assembly structured to select an output mode of the indicator light, and an output assembly structured to control the output modes of the indicator light. The locator assembly is in electronic communication with the selector assembly. The locator assembly communicates astronomic data for the indicator light to the selector assembly. The selector assembly selects an output mode of the indicator light based on the astronomic data for the indicator light.

That is, as used herein, "astronomic data" means data indicating a location on the earth and the time at that location. Thus, when the selector assembly selects an output mode of the indicator light based on the astronomic data for the indicator light, the output mode is not related to ambient light or the condition of the associated construct or device, but rather on the known and predictable astronomic conditions at the indicator light.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
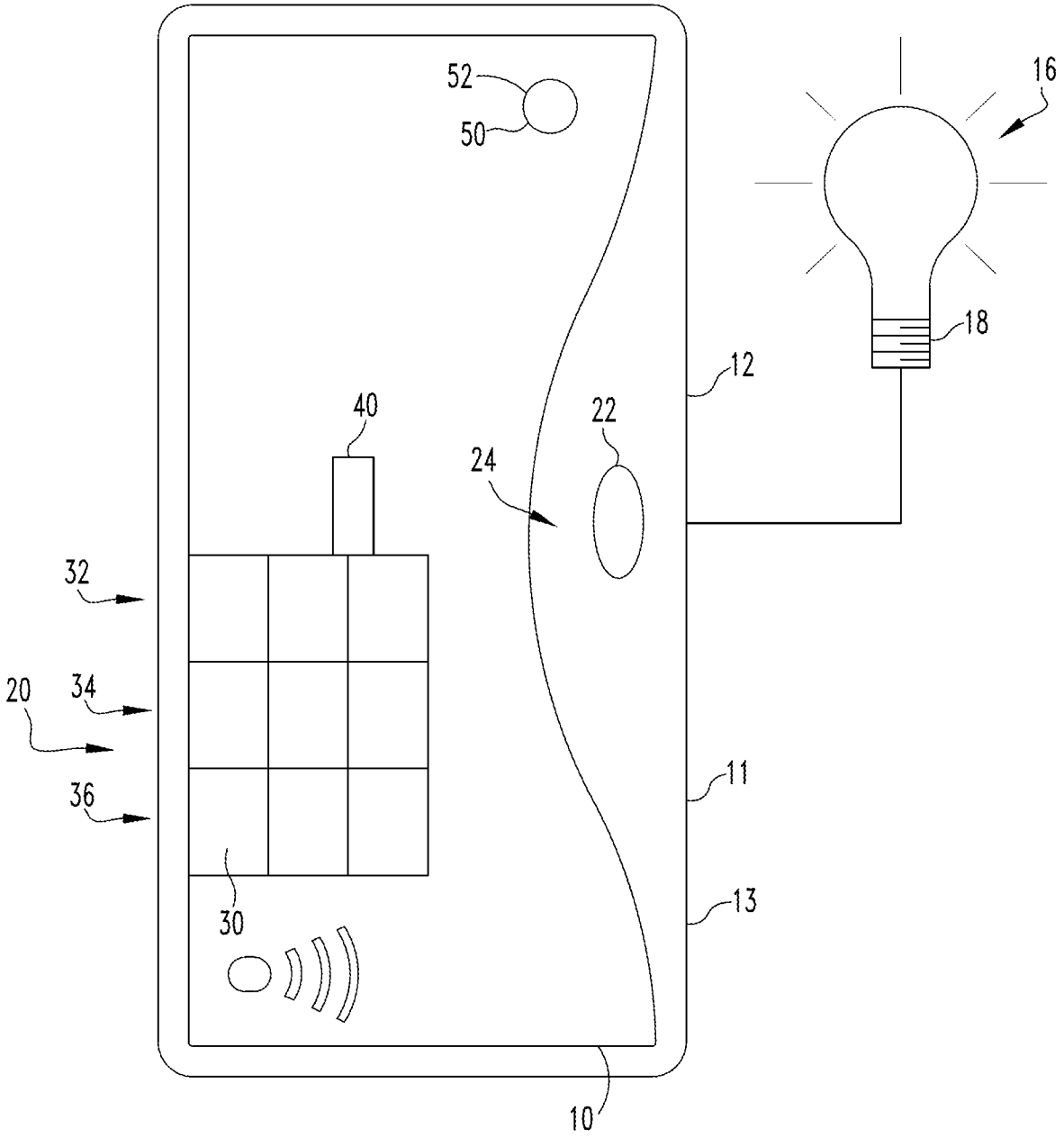
FIG. 1 is a schematic front view of a control device.

It will be appreciated that the specific elements illustrated in the figures herein and described in the following specification are simply exemplary embodiments of the disclosed concept, which are provided as non-limiting examples solely for the purpose of illustration. Therefore, specific dimensions, orientations, assembly, number of components used, embodiment configurations and other physical characteristics related to the embodiments disclosed herein are not to be considered limiting on the scope of the disclosed concept.

Directional phrases used herein, such as, for example, clockwise, counterclockwise, left, right, top, bottom, upwards, downwards and derivatives thereof, relate to the orientation of the elements shown in the drawings and are not limiting upon the claims unless expressly recited therein.

As used herein, the singular form of "a," "an," and "the" include plural references unless the context clearly dictates otherwise.

As used herein, "structured to [verb]" means that the identified element or assembly has a structure that is shaped, sized, disposed, coupled and/or configured to perform the identified verb. For example, a member that is "structured to move" is movably coupled to another element and includes elements that cause the member to move or the member is otherwise configured to move in response to other elements or assemblies. As such, as used herein, "structured to [verb]" recites structure and not function. Further, as used herein, "structured to [verb]" means that the identified element or assembly is intended to, and is designed to, perform the identified verb. Thus, an element that is merely capable of performing the identified verb but which is not intended to, and is not designed to, perform the identified verb is not "structured to [verb]."

As used herein, "associated" means that the elements are part of the same assembly and/or operate together, or, act upon/with each other in some manner. For example, an automobile has four tires and four hubcaps. While all the elements are coupled as part of the automobile, it is understood that each hubcap is "associated" with a specific tire.

As used herein, a "coupling assembly" includes two or more couplings or coupling components. The components of a coupling or coupling assembly are generally not part of the same element or other component. As such, the components of a "coupling assembly" may not be described at the same time in the following description.

As used herein, a "coupling" or "coupling component(s)" is one or more component(s) of a coupling assembly. That is, a coupling assembly includes at least two components that are structured to be coupled together. It is understood that the components of a coupling assembly are compatible with each other. For example, in a coupling assembly, if one coupling component is a snap socket, the other coupling component is a snap plug, or, if one coupling component is a bolt, then the other coupling component is a nut or threaded bore.

As used herein, the statement that two or more parts or components are "coupled" shall mean that the parts are joined or operate together either directly or indirectly, i.e., through one or more intermediate parts or components, so long as a link occurs. As used herein, "directly coupled" means that two elements are directly in contact with each other. As used herein, "fixedly coupled" or "fixed" means that two components are coupled so as to move as one while maintaining a constant orientation relative to each other. Accordingly, when two elements are coupled, all portions of those elements are coupled. A description, however, of a specific portion of a first element being coupled to a second element, e.g., an axle first end being coupled to a first wheel, means that the specific portion of the first element is disposed closer to the second element than the other portions thereof. Further, an object resting on another object held in place only by gravity is not "coupled" to the lower object unless the upper object is otherwise maintained substantially in place. That is, for example, a book on a table is not coupled thereto, but a book glued to a table is coupled thereto.

As used herein, the phrase "removably coupled" or "temporarily coupled" means that one component is coupled with another component in an essentially temporary manner. That is, the two components are coupled in such a way that the joining or separation of the components is easy and would not damage the components. For example, two components secured to each other with a limited number of readily accessible fasteners, i.e., fasteners that are not difficult to access, are "removably coupled" whereas two components that are welded together or joined by difficult to access fasteners are not "removably coupled." A "difficult to access fastener" is one that requires the removal of one or more other components prior to accessing the fastener wherein the "other component" is not an access device such as, but not limited to, a door.

As used herein, "operatively coupled" means that a number of elements or assemblies, each of which is movable between a first position and a second position, or a first configuration and a second configuration, are coupled so that as the first element moves from one position/configuration to the other, the second element moves between positions/configurations as well. It is noted that a first element may be "operatively coupled" to another without the opposite being true. With regard to electronic devices, a first electronic device is "operatively coupled" to a second electronic device when the first electronic device is structured to, and does, send a signal or current to the second electronic device causing the second electronic device to actuate or otherwise become powered or active.

As used herein, "correspond" indicates that two structural components are sized and shaped to be similar to each other and may be coupled with a minimum amount of friction.

Thus, an opening which "corresponds" to a member is sized slightly larger than the member so that the member may pass through the opening with a minimum amount of friction. This definition is modified if the two components are to fit "snugly" together. In that situation, the difference between the size of the components is even smaller whereby the amount of friction increases. If the element defining the opening and/or the component inserted into the opening are made from a deformable or compressible material, the opening may even be slightly smaller than the component being inserted into the opening. With regard to surfaces, shapes, and lines, two, or more, "corresponding" surfaces, shapes, or lines have generally the same size, shape, and contours. With regard to elements/assemblies that are movable or configurable, "corresponding" means that when elements/assemblies are related and that as one element/assembly is moved/reconfigured, then the other element/assembly is also moved/reconfigured in a predetermined manner. For example, a lever including a central fulcrum and elongated board, i.e., a "see-saw" or "teeter-totter," the board has a first end and a second end. When the board first end is in a raised position, the board second end is in a lowered position. When the board first end is moved to a lowered position, the board second end moves to a "corresponding" raised position. Alternately, a cam shaft in an engine has a first lobe operatively coupled to a first piston. When the first lobe moves to its upward position, the first piston moves to a "corresponding" upper position, and, when the first lobe moves to a lower position, the first piston, moves to a "corresponding" lower position.

As used herein, the statement that two or more parts or components "engage" one another means that the elements exert a force or bias against one another either directly or through one or more intermediate elements or components. Further, as used herein with regard to moving parts, a moving part may "engage" another element during the motion from one position to another and/or may "engage" another element once in the described position. Thus, it is understood that the statements, "when element A moves to element A first position, element A engages element B," and "when element A is in element A first position, element A engages element B" are equivalent statements and mean that element A either engages element B while moving to element A first position and/or element A engages element B while in element A first position.

As used herein, "operatively engage" means "engage and move." That is, "operatively engage" when used in relation to a first component that is structured to move a movable or rotatable second component means that the first component applies a force sufficient to cause the second component to move. For example, a screwdriver may be placed into contact with a screw. When no force is applied to the screwdriver, the screwdriver is merely "temporarily coupled" to the screw. If an axial force is applied to the screwdriver, the screwdriver is pressed against the screw and "engages" the screw. However, when a rotational force is applied to the screwdriver, the screwdriver "operatively engages" the screw and causes the screw to rotate. Further, with electronic components, "operatively engage" means that one component controls another component by a control signal or current.

As used herein, the word "unitary" means a component that is created as a single piece or unit. That is, a component that includes pieces that are created separately and then coupled together as a unit is not a "unitary" component or body.

As used herein, the term "number" shall mean one or an integer greater than one (i.e., a plurality). That is, for example, the phrase "a number of elements" means one element or a plurality of elements. It is specifically noted that the term "a 'number' of [X]" includes a single [X].

As used herein, "in electronic communication" is used in reference to communicating a signal via an electromagnetic wave or signal. "In electronic communication" includes both hardline and wireless forms of communication; thus, for example, a "data transfer" or "communication method" via a component "in electronic communication" with another component means that data is transferred from one computer to another computer (or from one processing assembly to another processing assembly) by physical connections such as USB, Ethernet connections or remotely such as blue tooth, etc. and should not be limited to any specific device.

As used herein, "in electric communication" means that a current passes, or can pass, between the identified elements. Being "in electric communication" is further dependent upon an element's position or configuration. For example, in a circuit breaker, a movable contact is "in electric communication" with the fixed contact when the contacts are in a closed position. The same movable contact is not "in electric communication" with the fixed contact when the contacts are in the open position.

As used herein, a "computer" is a device structured to process data having at least one input device, e.g., a keyboard, mouse, or touch-screen, at least one output device, e.g., a display, a graphics card, a communication device, e.g., an Ethernet card or wireless communication device, permanent memory, e.g., a hard drive, temporary memory, i.e., random access memory, and a processor, e.g., a programmable logic circuit. The "computer" may be a traditional desktop unit but also includes cellular telephones, tablet computers, laptop computers, as well as other devices, such as gaming devices that have been adapted to include components such as, but not limited to, those identified above. Further, the "computer" may include components that are physically in different locations. For example, a desktop unit may utilize a remote hard drive for storage. Such physically separate elements are, as used herein, a "computer."

As used herein, the word "display" means a device structured to present a visible image. Further, as used herein, "present" means to create an image on a display which may be seen by a user.

As used herein, a "computer readable medium" includes, but is not limited to, hard drives, CDs, DVDs, magnetic tape, floppy drives, and random access memory.

As used herein, "permanent memory" means a computer readable storage medium and, more specifically, a computer readable storage medium structured to record information in a non-transitory manner. Thus, "permanent memory" is limited to non-transitory tangible media.

As used herein, "stored in the permanent memory" means that a module of executable code, or other data, has become functionally and structurally integrated into the storage medium.

As used herein, a "file" is an electronic storage construct for containing executable code that is processed, or, data that may be expressed as text, images, audio, video or any combination thereof.

As used herein, a "module" is an electronic construct used by a computer, or other processing assembly, and includes, but is not limited to, a computer file or a group of interacting computer files such as an executable code file and data storage files, used by a processor and stored on a computer readable medium. Modules may also include a number of other modules. It is understood that modules may be identified by their purpose of function. Unless noted otherwise, each "module" is stored in, i.e., incorporated into, permanent memory of at least one computer or processing assembly. As such, and as used herein, all modules define constructs and do not recite a function. All modules are shown schematically in the Figures.

As used herein, "structured to [verb]" when used in relation to a module, means that the module includes executable computer instructions, code, or similar elements that are designed and intended to achieve the purpose of the module. As noted above, all modules are incorporated into permanent memory and, as such, define constructs and do not recite a function.

As used herein, "about" in a phrase such as "disposed about [an element, point or axis]" or "extend about [an element, point or axis]" or "[X] degrees about an [an element, point or axis]," means encircle, extend around, or measured around. When used in reference to a measurement or in a similar manner, "about" means "approximately," i.e., in an approximate range relevant to the measurement as would be understood by one of ordinary skill in the art.

As used herein, "generally" means "in a general manner" relevant to the term being modified as would be understood by one of ordinary skill in the art.

As used herein, "substantially" means "for the most part" relevant to the term being modified as would be understood by one of ordinary skill in the art.

As used herein, "at" means on and/or near relevant to the term being modified as would be understood by one of ordinary skill in the art.

As used herein, an "indicator" light means a light that is structured to communicate information as to the status of an associated construct or device. That is, an "indicator" light is always associated with another construct or device. Typically, the other construct or device is an electronically powered construct or device. In an exemplary embodiment, an "indicator" light is small.

As used herein, an "illumination" light means a light that is structured to illuminate an area. That is, a light bulb in a lamp or an overhead light is an "illumination" light.

As used herein, "automatic" means a construct that operates without direct human input/action. That is, a construct that operates incidentally following a human input/action is an "automatic" construct. For example, a user turns on a computer. When the computer boots the action is not "automatic" because the user caused the computer to be powered. Subsequently, a cooling fan in the computer is actuated without user input. The cooling fan is, as used herein "automatic." That is, while the cooling fan would not have been actuated if the computer was not powered, the actuation of the cooling fan was incidental to the act of powering the computer. Further, a construct is "automatic" even if it needs a human to initially set it up or install it and/or perform maintenance or calibration so long as the construct generally performs thereafter without human input/action.

Figure 2:
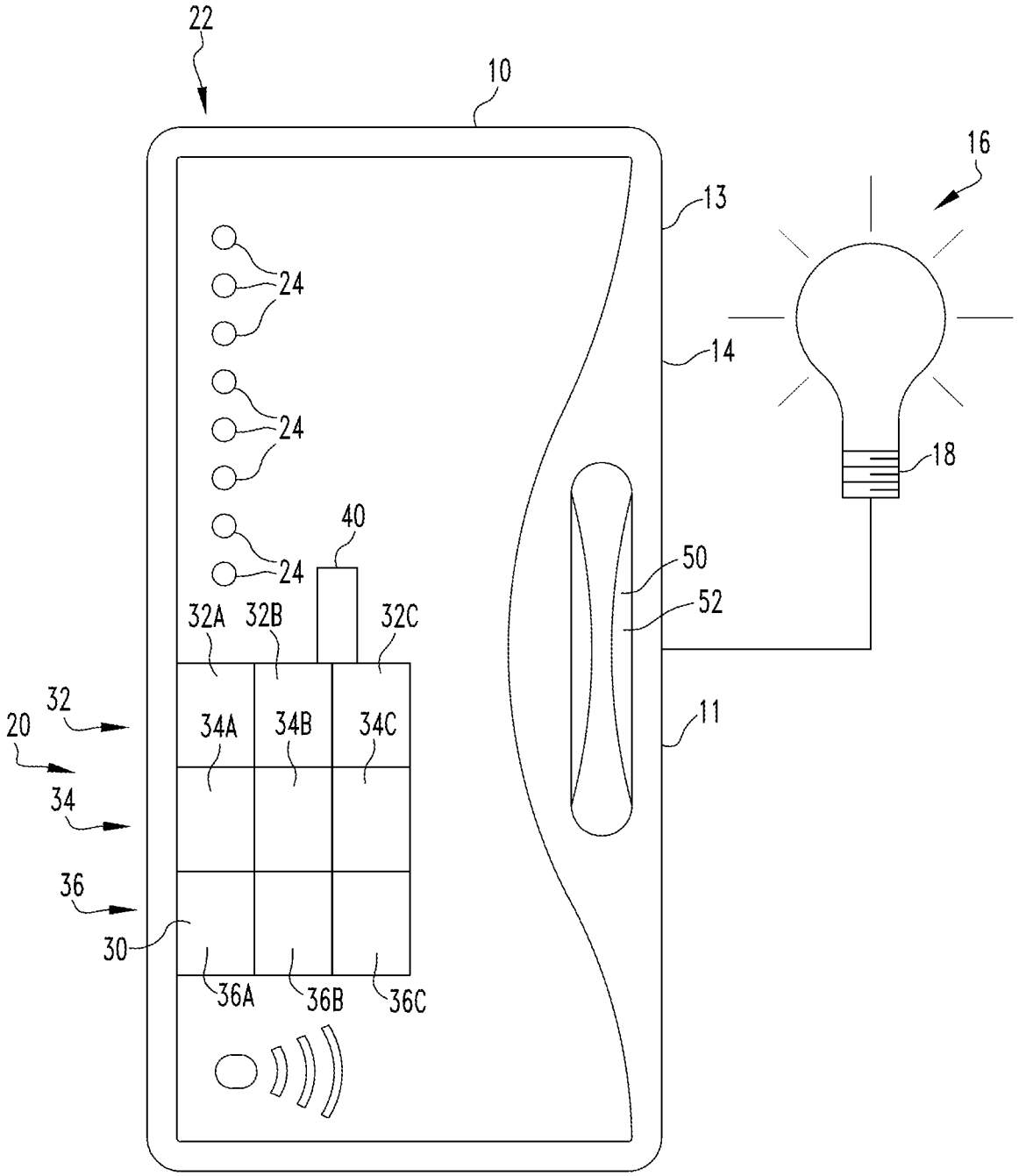
FIG. 2 is a schematic front view of another embodiment of a control device.
Figure 3:
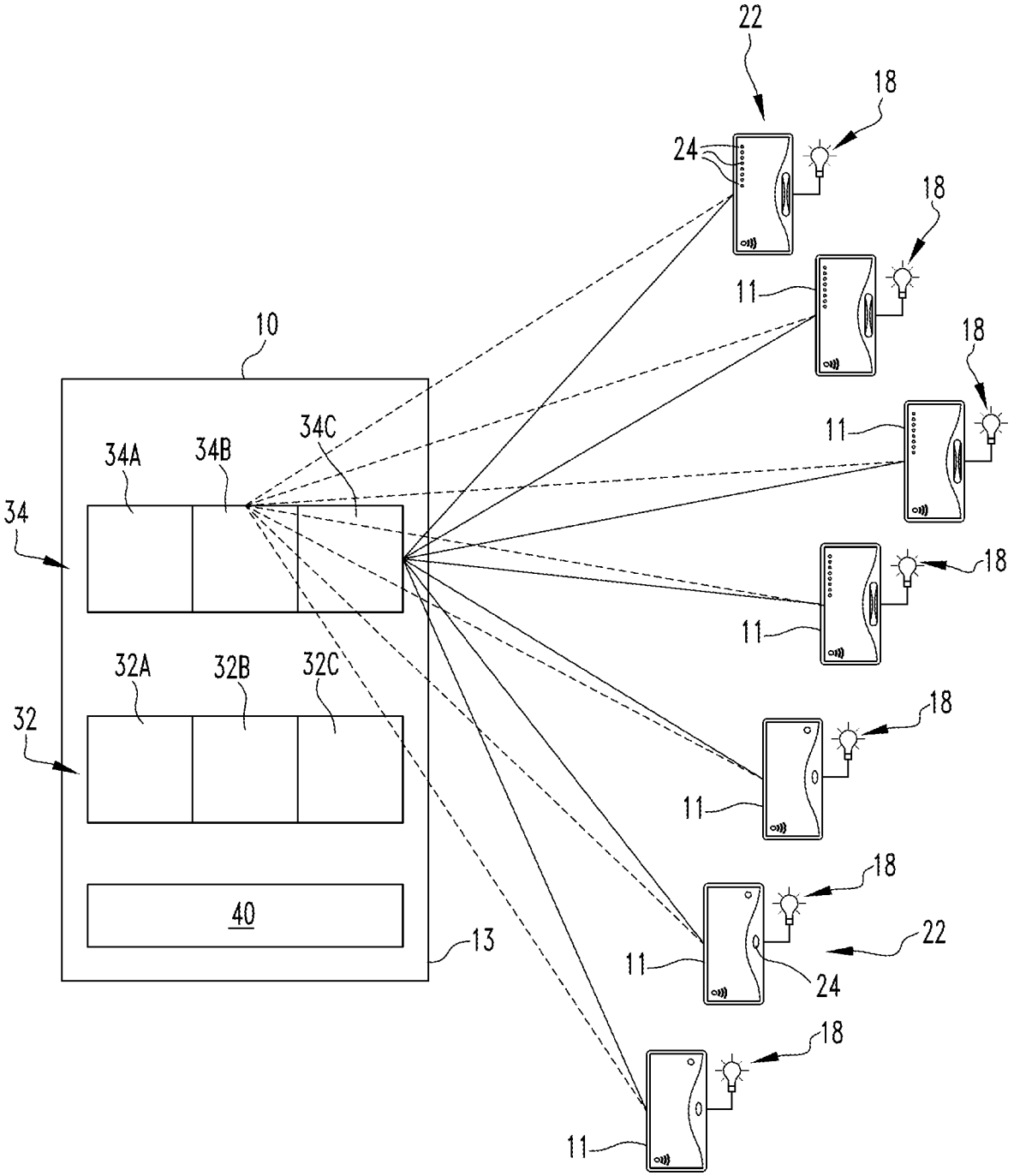
FIG. 3 is a schematic front view of another embodiment of a control device.

As shown in FIGS. 1 and 2, a control device 10 includes a housing assembly 11 and an indicator light assembly 20. As shown, the control device 10 is presented as a light switch assembly 12 (FIG. 1), a dimmer switch assembly 14 (FIG. 2) or a router 15 (FIG. 3). It is understood that, in these examples, the control device 10 is operatively coupled to a use device 16 which, in this example, is an "illumination" light 18 that lights up an area. It is further understood that this specific type of control device 10 is only an example and the disclosed and claimed concept is not limited to this specific type of control device 10. As is known, a user actuates the control device 10 to control the use device 16. That is, when the light switch assembly 12 is actuated, the illumination light 18 is turned on/off. Alternatively, when the control device 10 is a dimmer switch assembly 14, actuation of the control device 10 causes the illumination light 18 to change between a plurality of illumination levels, e.g., off, full dim, slightly dim, slightly bright and full bright. The control device 10 further includes a control assembly and an electronic communication assembly (neither shown). The control assembly is structured to, and does, control the communication assembly and performs other functions as is known. The communication assembly is structured to be, and is, in electronic communication with the use device 16, e.g., via a wired or wireless communication assembly. The control assembly and an electronic communication assembly are both disposed in the housing assembly 11.

The indicator light assembly 20 includes an indicator light 22 and a control assembly 30. The indicator light assembly 20 is structured to, and does, provide illumination from an indicator light 22 in a selected output mode based upon astronomical data associated with the indicator light assembly 20. The indicator light assembly 20 is, in one embodiment, unified at a single location, such as within the control device housing assembly 11. Stated alternately, an indicator light assembly control assembly 30, i.e., a locator assembly 32, a selector assembly 34, and an output assembly 36 (all discussed below) are unified. As used herein, "unified" means that all the elements of an assembly are disposed in a single location and/or within a single housing, frame or similar construct. In another embodiment, the indicator light assembly 20 is non-unified and includes elements in multiple locations, as discussed below.

The indicator light assembly indicator light 22 (hereinafter, "indicator light" 22) is structured to, and does, emit light in more than two output modes. In one exemplary embodiment, not shown, the indicator light 22 is structured to, and does, emit light in different colors. That is, a first output mode is the indicator light 22 illuminating in the color blue, in a second output mode the indicator light 22 illuminates in the color red and in a second output mode the indicator light 22 illuminates in the color purple. In the embodiment discussed in detail herein, the indicator light 22 is an LED 24 that is structured to have more than two output modes wherein the output modes relate to an amount of illumination. As the example used herein, the LED 24 is structured to and does illuminate in three illumination output modes: a low illumination, first output mode, an intermediate illumination, second output mode, and a high illumination, third output mode. Further, as used herein, "more than two output modes" for an indicator light 22 relates to levels of illumination, e.g., dim/low illumination, bright/high illumination, or a color but does not include a selectively actuated light. That is, as used herein, "more than two output modes" for an indicator light 22 does not include "on," "off," and an alternating on/off (or for lights that are always illuminated, bright, dim, and alternating bright/dim) output mode, i.e., blinking. Such a light has only two "output modes," on and off; the fact that the light is selectively switching between these output modes does not create a new/different "output mode." Similarly, a light that is always illuminated but which switches between bright, dim, and alternating bright/dim also has only two "output modes." Further, as used herein "blinking" includes alternating in on/off (or alternating bright/dim) in a selected pattern, e.g., illuminated for three seconds and not illuminated for one second. Thus, an indicator light 22 that is "on," "off" or "blinking" has only two "output modes," as used herein. It is understood that the three output modes, i.e., a low illumination, first output mode, an intermediate illumination, second output mode, and a high illumination, third output mode, are exemplary and that an indicator light 22 in other embodiments has more output modes, e.g., full dim illumination, slightly dim illumination, slightly bright illumination and full bright illumination. It is further understood that, and as used herein, "low illumination/dim," "intermediate illumination/intermediate," and "high illumination/bright" are relative terms wherein, for example, an indicator light 22 in the "low illumination/dim" output mode produces less illumination than the same indicator light 22 in the "high illumination/bright" output mode.

The indicator light assembly control assembly 30 (hereinafter, "control assembly" 30) is structured to, and does, determine the astronomical data associated with the indicator light assembly 20, and, control the level of illumination of the indicator light 22. The control assembly 30 includes a locator assembly 32, a selector assembly 34, and an output assembly 36. Generally, and in an exemplary embodiment, any or all of the locator assembly 32, the selector assembly 34, and the output assembly 36 include a processor, e.g., a programmable logic circuit 32A, 34A, 36A, and permanent memory 32B, 34B, 36B as well as a module 32C, 34C, 36C stored in the permanent memory, shown schematically. It is understood that each module 32C, 34C, 36C includes instructions that are performed by the programmable logic circuit 32A, 34A, 36A. It is further understood that a programmable logic circuit, in an exemplary embodiment, is structured to perform multiple functions. As such, and in an embodiment not shown, the control assembly 30, and the elements thereof, are incorporated into a single programmable logic circuit having an associated permanent memory and a number of modules structured to operate with the identified subassemblies. That is, in another embodiment, the locator assembly 32, the selector assembly 34, and the output assembly 36 are incorporated into a single processor and/or permanent memory construct.

The locator assembly 32 is structured to, and does, determine the astronomic data for the locator assembly 32. That is, the locator assembly 32 (and/or the locator assembly module 32C) is structured to, and does, detect a local communication signal including astronomic data. As used herein, a "communication signal" means a wireless signal. In an exemplary embodiment, the locator assembly 32 is, or includes, a global positioning system (GPS) assembly 40. As is known, a GPS assembly 40 interacts with a satellite network (not shown) so as to determine the location of the GPS assembly 40. The information communicated by the satellite network also includes the time at the location of the GPS assembly 40. Alternatively, or additionally, the locator assembly 32 is structured to, and does, interact with a wireless communication signal such as, but not limited to, a wireless local area networking signal, hereinafter "WI-FI®" (WI-FI is a registered trademark of the Wi-Fi Alliance, 10900-B Stonelake Boulevard, Suite 126, Austin, Tex. 78759 U.S.A.). As is known, location and time data, as determined by the Internet, i.e., any component of the Internet such as, but not limited to controllers and gateways, is included with a WI-FI® signal. That is, it is understood that a typical wireless router 15 (FIG. 3) sends a signal that includes data representing the location of, and the time at, the wireless router. As another example, cellular signals, i.e., signals that communicate with cellular telephones, include astronomic data. Thus, the locator assembly 32 in one embodiment is structured to receive cellular signals.

In another exemplary embodiment, the locator assembly 32 is structured to, and does, determine the astronomic data for the locator assembly 32 based on user input. That is, in an embodiment not shown, the locator assembly 32 includes a keypad or other input device, or is structured to be in electronic communication with a keypad or other input device. The input device is structured to, and does, allow a user to provide input that allows the locator assembly 32 to identify its location and the local time, i.e., the astronomic data for the locator assembly 32. For example, in one embodiment, the locator assembly 32 includes a database module that associates postal codes to geographic locations. In this embodiment, the user inputs a postal code such as, but not limited to, a ZIP code. The locator assembly 32 then determines its geographic locations by comparing the user input to the database. In another embodiment, the user inputs a latitude and longitude and the local time thereby manually inputting the astronomic data.

In one embodiment, the locator assembly 32 is structured to, and does, determine the astronomic data for the locator assembly 32 automatically and at regular intervals. That is, the locator assembly 32 is structured to, and does, communicate with the source of astronomic data without user input. In an exemplary embodiment, the locator assembly 32 is structured to, and does, communicate with the source of astronomic data according to predetermined schedule, e.g., once per minute, once per day, etc. In another exemplary embodiment, the locator assembly 32 is structured to, and does, communicate with the source of astronomic data following a specific action, e.g., turning on the illumination light 18. It is noted that, while turning on the illumination light 18 requires an action by a user, the locator assembly 32 still operates "automatically" in that the user does not specifically cause the locator assembly 32 to communicate with the source of astronomic data. The locator assembly 32 is structured to be, and is, in electronic communication with the selector assembly 34. That is, the locator assembly 32 is structured to, and does, generate a signal that includes astronomic data. The locator assembly 32 signal is communicated to the selector assembly 34.

The selector assembly 34 is structured to, and does, select an output mode for indicator light 22 based upon the astronomic data. That is, the selector assembly 34 (and/or the selector assembly module 34C) is structured to, and does, identify the desired output mode for indicator light 22 in view of the provided astronomic data. The selector assembly 34 is structured to be, and is, in electronic communication with the locator assembly 32. That is, the selector assembly 34 is structured to, and does, receive the locator assembly 32 signal. In an exemplary embodiment, the selector assembly module 34C includes a database correlating an output mode with the astronomic data. That is, for example, the selector assembly module 34C is structured to, and does, include data identifying sunset at a specific time for a specific date and at a specific location. The selector assembly module 34C is further structured to, and does, identifies all times within about thirty minutes prior to and after sunset as a "twilight" period. The selector assembly module 34C is further structured to, and does, associate an indicator light 22 output mode with the "twilight" period. It is understood that the selector assembly module 34C is further structured to, and does, associate an indicator light 22 output mode with all times of the day and for each date and location.

For example, at Pittsburgh, Pa., and on the winter solstice, it is dark at 6:00 PM (standard time), on the spring and fall equinoxes it is twilight at 6:00 PM, and on the summer solstice the sun is still up at 6:00 PM. In this example, it is desired that the illumination of the indicator light 22 generally corresponds to the astronomic illumination. That is, the indicator light 22 is brightly illuminated (high illumination) during daylight, intermediately illuminated during twilight, and dimly illuminated (low illumination) during night. Thus, in this example, the selector assembly 34 is structured to, and does, select the low illumination output mode at 6:00 PM on the winter solstice. Further, the selector assembly 34 is structured to, and does, select the intermediate illumination output mode at 6:00 PM on the equinoxes. Further, the selector assembly 34 is structured to, and does, select the high illumination output mode at 6:00 PM on the summer solstice. Thus, in an exemplary embodiment, the selector assembly 34 is structured to, and does, identify at least three astronomic periods for each day including a first astronomic period (night), a second astronomic period (twilight) and a third astronomic period (daytime). As used herein, an "astronomic period" means a period of the day at a location wherein the outdoor lighting, i.e., natural lighting disregarding cloud cover, is different when compared to other "astronomic periods" for that location. That is, at a given location, daytime has different outdoor lighting than night. Conversely, at a given location, the outdoor lighting at 1:00 PM is generally the same as the outdoor lighting at 2:00 PM. As used herein, the "astronomic periods" include at least daytime (or day), night, and twilight. In one embodiment, wherein the indicator light 22 has three output modes, civil twilight and nautical twilight are included with the twilight "astronomic period" while astronomical twilight is included as part of the night "astronomic period." In another embodiment, wherein the indicator light 22 has more than three output modes, the "astronomic periods" include at least daytime (or day) and night as well as at least one of civil twilight, nautical twilight, and astronomical twilight.

The selector assembly 34 is structured to, and does, generate a signal that includes output mode data. Further, the selector assembly 34 is structured to be, and is, in electronic communication with the output assembly 36. Thus, the selector assembly 34 signal is communicated to the output assembly 36. In an exemplary embodiment, the selector assembly 34, or the indicator light assembly 20, includes a wireless communication device (not shown) such as, but not limited to, a wireless Universal Serial Bus (USB) adaptor. Further, in an exemplary embodiment, the wireless communication device has a limited range. As used herein, a "limited range" means less than one hundred feet. It is understood that wireless communication devices are, in some instances, linked thereby forming a network with a greater range. The term "limited range" relates to the range of an individual wireless communication device and not the range covered by such a network. Thus, the selector assembly 34, and therefore the indicator light assembly 20 is structured to control indicator lights 22 in a limited range. It is understood that the astronomical data for all locations within a "limited range" is the same.

The output assembly 36 is operatively coupled to an associated indicator light 22 and is structured to, and does, control the output modes of the indicator light 22. That is, the output assembly 36 (and/or the output assembly module 36C) is structured to, and does, cause the indicator light 22 to illuminate in a selected output mode. The output assembly 36 is structured to, and does, receive the selector assembly 34 signal. Based upon the output mode data in the selector assembly 34 signal, the output assembly 36 actuates the indicator light 22 to illuminate in a selected output mode.

In an exemplary embodiment, the output assembly 36 actuates the indicator light 22 to illuminate in a selected output mode by varying the current supplied to the indicator light 22. That is, the greater the current supplied, the brighter the output of the indicator light 22. In this exemplary embodiment, the output assembly 36 is structured to, and does, supply the indicator light 22 with a low current (which is associated with the dim/low illumination, first output mode), an intermediate current (which is associated with the intermediate/intermediate illumination, second output mode), or a high current (which is associated with the bright/high illumination, third output mode).

In one exemplary embodiment, indicator light assembly 20 including all the elements of the control assembly 30, i.e., the locator assembly 32, the selector assembly 34, and the output assembly 36, are located in a single location which is the location of the indicator light 22. That is, for example, the unified indicator light assembly 20 is disposed in the control device housing assembly 11. Thus, in this embodiment, if a house includes twenty control devices 10, i.e., twenty light switch assemblies 12, each control device 10 includes all the elements of the control assembly 30.

In another exemplary embodiment, selected elements of the indicator light assembly 20 (or the control assembly 30) are disposed at different locations. That is, the indicator light assembly 20 (or the control assembly 30) is non-unified. For example, a locator assembly 32 and a selector assembly 34 are disposed in one location, as shown, a base housing assembly 13, while the output assemblies 36 are disposed at each control device 10, i.e., within each control device housing assembly 11. For example, the locator assembly 32 and a selector assembly 34 are disposed in a WI-FI® router (the base housing assembly 13) while the output assemblies 36 are disposed in each light switch assembly 12. In this embodiment, each output assembly 36 includes a communication assembly (not shown) such as, but not limited to, a wireless modem that is structured to be, and is, in electronic communication with the selector assembly 34.

In operation, the indicator light assembly 20 operates as follows. The locator assembly 32 determines the astronomic data for the locator assembly 32. For example, if the locator assembly 32 includes a GPS assembly 40, the locator assembly 32 utilizes GPS signal(s) to determine the location of the locator assembly 32 as well as the local time. The astronomic data is communicated to the selector assembly 34 which selects an output mode for indicator light 22 based upon the astronomic data. That is, the selector assembly 34 compares the astronomic data to the database correlating an output mode with the astronomic data thereby determining an output mode. The output mode is communicated to the output assembly 36 via the selector assembly 34 signal. The output assembly 36 then actuates the indicator light 22 based upon the selector assembly 34 signal. It is noted that, in an exemplary embodiment and in a non-unified configuration, the selector assembly 34 only communicates with output assemblies 36 that are within a limited range. That is, the selector assembly 34 is structured to, and does, communicate with output assemblies 36 with the same astronomical data.

As a specific example, the indicator light assembly 20 is disposed in Pittsburgh, Pa. and the date is March 21 at 6:00 PM EDT. The locator assembly 32 accesses a GPS signal and determines that the locator assembly 32 is in Pittsburgh and that the local time is 6:00 PM EDT. This astronomic data is communicated to the selector assembly 34. The selector assembly 34 database includes information indicating that at 6:00 PM EDT on March 21, the sun is setting. That is, it is twilight. The selector assembly 34 database further associates the intermediate/intermediate illumination, second output mode as the applicable output mode to use at twilight. The output mode information is included in the selector assembly 34 signal that is communicated to the output assembly 36. The output assembly 36 receives the selector assembly 34 signal and then provides an intermediate current to the indicator light 22. Thus, the indicator light 22 then provides an intermediate amount of illumination. This configuration solves the problems noted above.

It is noted that, in this configuration, the indicator light assembly 20 including all the elements of the control assembly 30, i.e., the locator assembly 32, the selector assembly 34, and the output assembly 36, are not coupled to, or in communication with, a photocell. Thus, the indicator light assembly 20 including the control assembly 30 does not utilize the complicated and expensive hardware and software associated with use of a photocell. This solves the problems noted above.

Further, the indicator light assembly 20, i.e., the control assembly 30, in an exemplary embodiment, is structured to, and does, operate automatically. That is, the user does not have to provide any input to the indicator light assembly 20/control assembly 30 for the indicator light assembly 20/control assembly 30 to control the level of illumination of the indicator light 22.

In another embodiment, the selector assembly 34 includes a manual input assembly 50. The manual input assembly 50 is structured to override the mode determined by the selector assembly 34. In one embodiment, the manual input assembly 50 includes a single button 52. The button 52 is operatively coupled to the selector assembly 34 and actuation of the button 52 causes the selector assembly 34 to cycle through output modes. That is, each time a user actuates the button 52, the selector assembly 34 sends a signal indicating that a different output mode is active. Thus, for example, at noon during an exceptionally cloudy day, the selector assembly 34 includes data in the signal indicating that the bright/high illumination output mode is to be used. When the user actuates the button 52, the selector assembly 34 includes data in the signal indicating that the dim/low illumination output mode is to be used. A second actuation of the button 52 causes the selector assembly 34 to include data in the signal indicating that the intermediate/intermediate illumination output mode is to be used.

In another exemplary embodiment, the manual input assembly 50 is an application (or "app") (not shown) on a cellular telephone or on a computer that is in electronic communication with the control assembly 30. The application includes instructions allowing the user to identify selected indicator light assemblies 20, or all indicator light assemblies 20, operatively coupled to the control assembly 30 and to adjust the mode selected by the selector assembly 34.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof

What is claimed is:

1. A control assembly for an indicator light assembly, said indicator light assembly including an indicator light, said indicator light structured to emit light in more than two output modes, said control assembly comprising:

a locator assembly structured to determine the astronomic data associated with said locator assembly;

a selector assembly structured to select an output mode for said indicator light based upon the astronomic data;

an output assembly structured to control the output modes of said indicator light;

said locator assembly in electronic communication with said selector assembly;

wherein said locator assembly communicates astronomic data to said selector assembly;

wherein said selector assembly selects an output mode of said indicator light based on said astronomic data for said indicator light;

wherein said selector assembly communicates an output mode to said output assembly; and wherein said output assembly illuminates said indicator light in one of said output modes.

2. The control assembly of claim 1 wherein said indicator light more than two output modes includes at least a first output mode, a second output mode and a third output mode, and wherein:

said selector assembly structured to identify at least three astronomic periods for each day including a first astronomic period, a second astronomic period and a third astronomic period; and said selector assembly structured to automatically select said first output mode during said first astronomic period, said second output mode during said second astronomic period and said third output mode during said third astronomic period.

3. The control assembly of claim 2 wherein said locator assembly is structured to detect a communication signal including astronomic data.

4. The control assembly of claim 2 wherein said locator assembly is structured to detect a local communication signal selected from the group including GPS signals, cellular signals, and WIFI signals.

5. The control assembly of claim 2 wherein said indicator light is a light emitting diode (LED) and wherein said first output mode is a low illumination, first output mode, said second output mode is an intermediate illumination, second output mode and said third output mode is a high illumination, third output mode, and wherein:

wherein said first astronomic period is night;

wherein said second astronomic period is twilight; and wherein said third astronomic period is daytime.

6. The control assembly of claim 2 wherein said locator assembly is structured to determine the astronomic data for said locator assembly at regular intervals.

7. The control assembly of claim 2 wherein:

said selector assembly includes a manual input assembly; and said selector assembly structured to override an automatic selection upon receiving user input.

8. The control assembly of claim 2 wherein none of said locator assembly, said selector assembly and said output assembly are in communication with a photocell.

9. The control assembly of claim 2 wherein said selector assembly operates automatically.

10. The control assembly of claim 2 wherein said locator assembly, said selector assembly, and said output assembly are unified.

11. An indicator light assembly comprising:

an indicator light, said indicator light structured to emit light in more than two output modes;

a control assembly including a locator assembly, a selector assembly, and an output assembly;

said locator assembly structured to determine the astronomic data associated with said locator assembly;

said selector assembly structured to select an output mode for said indicator light based upon the astronomic data;

said output assembly operatively coupled to said indicator light and structured to control the output modes of said indicator light;

said locator assembly in electronic communication with said selector assembly;

wherein said locator assembly communicates astronomic data to said selector assembly;

wherein said selector assembly selects an output mode of said indicator light based on said astronomic data for said indicator light;

wherein said selector assembly communicates an output mode to said output assembly; and wherein said output assembly illuminates said indicator light in one of said output modes.

12. The indicator light assembly of claim 11 wherein said indicator light more than two output modes includes at least a first output mode, a second output mode and a third output mode, and wherein:

said selector assembly structured to identify at least three astronomic periods for each day including a first astronomic period, a second astronomic period and a third astronomic period; and said selector assembly structured to automatically select said first output mode during said first astronomic period, said second output mode during said second astronomic period and said third output mode during said third astronomic period.

13. The indicator light assembly of claim 12 wherein said locator assembly is structured to detect a communication signal including astronomic data.

14. The indicator light assembly of claim 12 wherein said locator assembly is structured to detect a local communication signal selected from the group including GPS signals, cellular signals, and WIFI signals.

15. The indicator light assembly of claim 12 wherein said indicator light is a light emitting diode (LED) and wherein said first output mode is a low illumination, first output mode, said second output mode is an intermediate illumination, second output mode and said third output mode is a high illumination, third output mode, and wherein:

said first astronomic period is night;

said second astronomic period is twilight; and said third astronomic period is daytime.

16. The indicator light assembly of claim 12 wherein said locator assembly is structured to determine the astronomic data for said locator assembly at regular intervals.

17. The indicator light assembly of claim 12 wherein:

said selector assembly includes a manual input assembly; and said selector assembly structured to override an automatic selection upon receiving user input.

18. The indicator light assembly of claim 12 wherein none of said locator assembly, said selector assembly and said output assembly are in communication with a photocell.

19. The indicator light assembly of claim 12 wherein said selector assembly operates automatically.

20. The indicator light assembly of claim 12 wherein said locator assembly, aid selector assembly, and said output assembly are unified.

* * * * *